United States Patent [19]

Rundell et al.

[11] Patent Number: 4,513,815

[45] Date of Patent: Apr. 30, 1985

[54] SYSTEM FOR PROVIDING RF ENERGY INTO A HYDROCARBON STRATUM

[75] Inventors: Herbert A. Rundell; Kerry D. Savage, both of Houston, Tex.

[73] Assignee: Texaco Inc., White Plains, N.Y.

[21] Appl. No.: 542,870

[22] Filed: Oct. 17, 1983

[51] Int. Cl.[3] ..... E21B 43/24

[52] U.S. Cl. ..... 166/57; 166/65 R

[58] Field of Search ..... 166/57, 60, 65 R, 248, 166/302

[56] References Cited

U.S. PATENT DOCUMENTS

| | | | |
|---|---|---|---|
| 3,444,279 | 5/1969 | Dost | 166/57 |
| 4,301,865 | 11/1981 | Kasevich et al. | 166/65 R |
| 4,398,597 | 8/1983 | Haberman | 166/65 R |
| 4,449,585 | 5/1984 | Bridges et al. | 166/248 |

*Primary Examiner*—Stephen J. Novosad
*Assistant Examiner*—William P. Neuder
*Attorney, Agent, or Firm*—Robert A. Kulason; Ronald G. Gillespie

[57] ABSTRACT

A system for emitting electromagnetic energy at a radio frequency into a hydrocarbon stratum of earth formation traversed by borehole includes a source having impedance matching capability, which provides electromagnetic energy at a radio frequency, and an applicator which is used to emit the RF energy into the hydrocarbon stratum. The applicator includes an outer conductor and an inner conductor that is substantially longer than the outer conductor. The outer conductor is arranged with the inner conductor in a manner so that a portion of the inner conductor is located within the outer conductor and the portion of the inner conductor not located within the outer conductor is used for emitting the RF energy when the applicator is energized by the source. An end piece affixed to the inner conductor holds a plurality of insulators in place. The insulators are of a type that should they come into contact with the inner conductor substantially no phase shift of the RF energy occurs.

10 Claims, 2 Drawing Figures

SYSTEM FOR PROVIDING RF ENERGY INTO A HYDROCARBON STRATUM

BACKGROUND OF THE INVENTION

1. Field of the Invention

The present invention relates to hydrocarbon producing systems in general and more particularly to a system of the RF retorting of a hydrocarbon stratum.

2. Summary of the Invention

A system for emitting electromagnetic energy at a radio frequency into a hydrocarbon stratum of earth formation traversed by borehole includes a source having an impedance matching capability, which provides electromagnetic energy at a radio frequency, and an applicator which is used to emit the RF energy into the hydrocarbon stratum. The applicator includes an outer conductor and an inner conductor that is substantially longer than the outer conductor. The outer conductor is arranged with the inner conductor in a manner so that a portion of the inner conductor is located within the outer conductor and the portion of the inner conductor not located within the outer conductor is used for emitting the RF energy when the applicator is energized by the source. An end piece affixed to the inner conductor holds a plurality of insulators in place. The insulators are of a type that should they come into contact with the inner conductor substantially no phase shift of the RF energy occurs.

The object and advantages of the present invention will appear more fully hereinafter from a consideration of the detailed description which follows, taken together with the accompanying drawings wherein one embodiment of the invention is illustrated by way of example. It is to be expressly understood, however, that the drawings are for illustration purpose only and are not to be construed as defining the limits of the invention.

DESCRIPTION OF THE INVENTION

Figure 1:
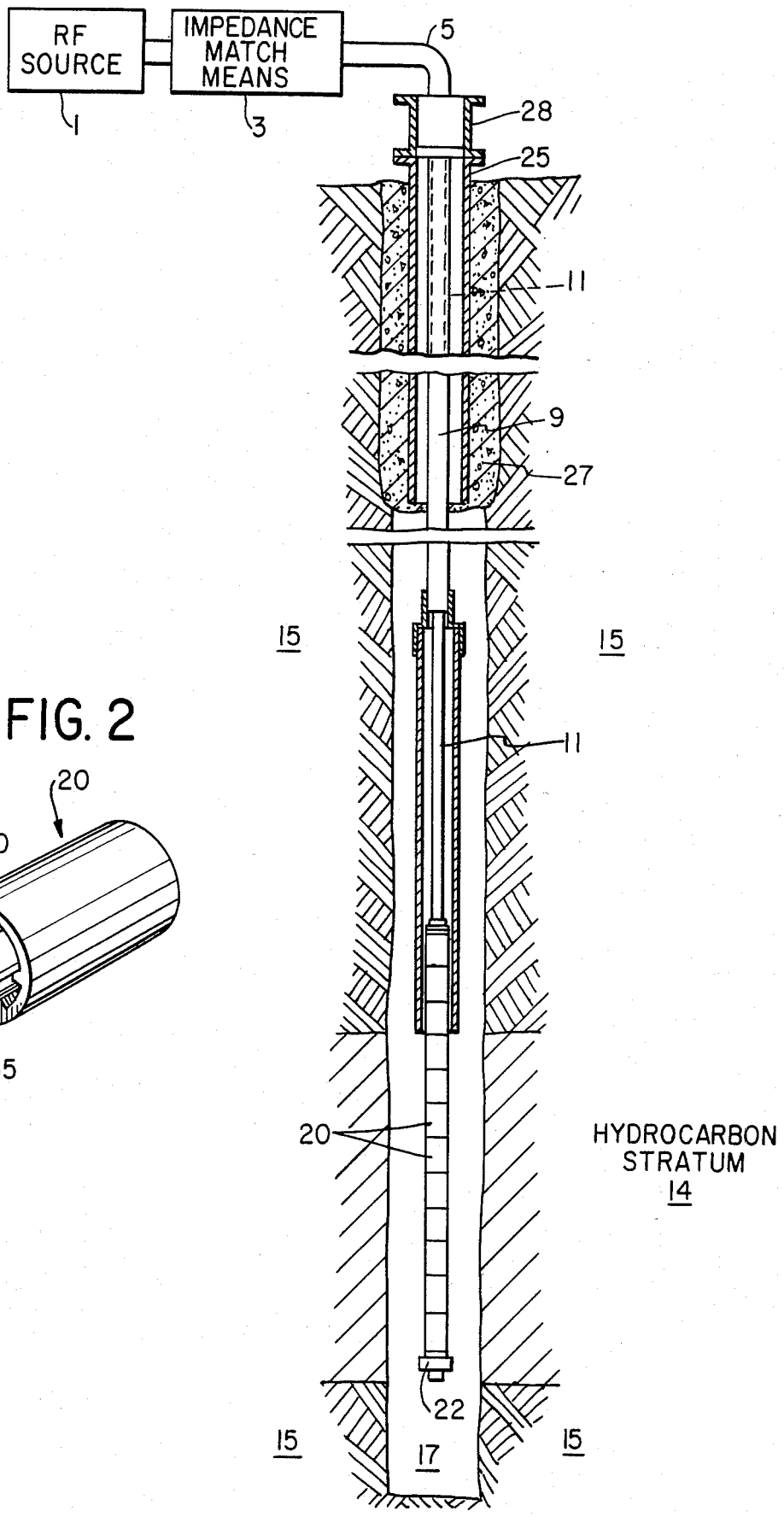
FIG. 1 is a graphical representation of an RF retorting system constructed in accordance with the present invention.

With reference to FIG. 1, a source 1 of electromagnetic energy provides a voltage at a frequency in the radio frequency range. The voltage is provided to impedance matching means 3 which provides the voltage through conduit 5 to an applicator having an outer conductor 9 and a hollow inner conductor 11 in a manner so that the RF voltage is provided between coaxial conductors 9 and 11 and RF energy is radiated into a hydrocarbon stratum 14 of an earth formation 15. The diameter of outer conductor 9 for impedance matching purposes is increased by use of adaptor 16 and a predetermined length of tubing 18. The RF applicator is in a borehole 17 traversing an earth formation 15 which includes a hydrocarbon stratum 14. Surrounding and insulating conductor 11 are ceramic insulators 20 of predetermined length held in place by an end piece 22.

Further, the upper portion of borehole 17 has an iron casing 25 which is cemented in place with cement 27. A well cap 28 provides suitable entrance for conduit 5 to the RF applicator.

Prior to the present invention, as the hydrocarbon stratum 14 heated up, it closed in on the ceramic insulators 20, insulators 20 would move and make contact with conductor 11. In doing so, the phase of the energy being transmitted into the formation was shifted, which required the operator to adjust the impedance matching means 3 to obtain an impedance match. This is a time consuming procedure and is difficult to maintain with the movement of hydrocarbon stratum 14. The present invention permits the movement of the ceramic insulators 20 in a manner so that when they do contact conductor 11 they will not substantially change the phase of the RF energy being emitted into hydrocarbon stratum 14. Therefore there is no need to keep adjusting the impedance match once achieved. The adjustment operation, prior to the present invention, was time consuming and difficult to maintain.

Figure 2:
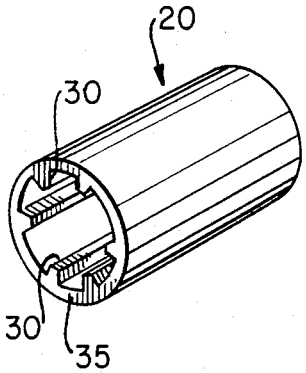
FIG. 2 is a pictorial drawing of an insulator shown in FIG. 1.

This is accomplished by using a ceramic insulator 20 of the type shown in FIG. 2 having ribs 30 which may be molded into a shell 35 of ceramic insulator 20 or could be affixed in any convenient manner. Ribs 30 in cooperation with shell 35 create an air gap between conductor 11 and the mass of shell 35 of ceramic insulator 20 so that the phase is not materially altered when insulator 20 contacts conductor 11.

The present invention is an applicator for radiating RF electromagnetic energy into a hydrocarbon stratum which does not require the re-matching of impedance as the hydrocarbon stratum closes in on the applicator.

We claim:

1. A system for emitting electromagnetic energy at a radio frequency into a hydrocarbon stratum of earth formations traversed by a borehold, comprising:

source means with impedance matching capabilities for providing electromagnetic energy at a radio frequency; and applicator means for emitting the RF energy from the source means into the hydrocarbon stratum; said applicator means includes:

an outer conductor, an inner conductor that is substantially longer than the outer conductor and arranged with the outer conductor so that a portion of the inner conductor is located within the outer conductor and a portion of the inner conductor not located within said outer conductor is used for emitting the RF energy;

an end piece affixed to the inner conductor, and a plurality of insulator means held in place by the end piece for insulating the inner conductor from the earth formations in a manner so that when any of the insulator means comes into contact with the inner conductor, substantially no phase shift of the RF energy occurs.

2. A system as described in claim 1 in which each insulator means is made of ceramic.

3. A system as described in claim 2 in which each insulator means includes shell means for completely surrounding the inner conductor to provide the insulation for the inner conductor, and means arranged with the shell means for preventing the shell means from contacting the inner conductor.

4. A system as described in claim 3 in which the preventing means are ribs.

5. A system as described in claim 2 in which each insulator means includes means for preventing an air gap between the insulator means and the inner conductor from decreasing below a predetermined minimum value.

6. Insulator means for use with an RF applicator comprising:

shell means having a predetermined length for surrounding a portion of an inner conductor of the RF applicator which emits RF energy so as to insulate that portion of the inner conductor, and means for preventing the shell means from contacting the inner conductor.

7. Insulator means as described in claim 6 in which the insulator means is made of ceramic.

8. Insulator means as described in claim 7 in which the preventing means are protrusions formed on the shell means.

9. Insulator means for use with an RF applicator comprising:

shell means having a predetermined length for surrounding a portion of an inner conductor of the RF applicator which emits RF energies so as to insulate that portion of the inner conductor, and means for preventing an air gap between the shell means and the inner conductor from decreasing below a predetermined value.

10. An insulator means as described in claim 9 in which the insulator means is made of ceramic.

* * * * *